United States Patent [19]

Wagle

[11] Patent Number: 4,484,040

[45] Date of Patent: Nov. 20, 1984

[54] DRIVE MEANS FOR A TIMING MECHANISM

[75] Inventor: William E. Wagle, Bloomington, Ind.

[73] Assignee: Emhart Industries, Inc., Indianapolis, Ind.

[21] Appl. No.: 544,629

[22] Filed: Oct. 24, 1983

Related U.S. Application Data

[63] Continuation of Ser. No. 337,430, Jan. 6, 1982, abandoned.

[51] Int. Cl.[3] ..... H01H 43/10

[52] U.S. Cl. ..... 200/38 R; 200/38 C

[58] Field of Search ..... 200/38 R, 38 B, 38 BA, 200/38 C, 38 CA, 39 R

[56] References Cited

U.S. PATENT DOCUMENTS

| | | | |
|---|---|---|---|
| 3,603,749 | 9/1971 | Davis | 200/38 C |
| 4,319,101 | 3/1982 | Bolin | 200/38 R |
| 4,442,326 | 4/1984 | Wagle | 200/38 C X |

*Primary Examiner*—J. R. Scott

*Attorney, Agent, or Firm*—Robert F. Meyer

[57] ABSTRACT

Rotation of a cam means of a timing mechanism is provided by two sets of axially aligned ratchet teeth having different major diameters and a drive pawl selectively engaging the two sets of teeth. A masking means provides a predetermined point at which the drive pawl engages the set of teeth having the lesser major diameter during the time the drive pawl is in working relation to that set of teeth. The arrangement provides a means to have short effective pawl strokes during non switching time periods.

2 Claims, 10 Drawing Figures

DRIVE MEANS FOR A TIMING MECHANISM

This application is a continuation of application Ser. No. 337,430, filed 1/6/82. now abandoned

BACKGROUND OF THE INVENTION

Generally speaking, the present invention pertains to a drive means of a timing mechanism which comprises first ratchet teeth of a first major diameter coupled to a cam means; second ratchet teeth of a second lesser major diameter in working relationship with the first ratchet teeth; a drive pawl having a fixed stroke selectively engaging the first and second ratchet teeth, the first and second ratchet teeth arranged with respect to each other to be separately selectively in working relation to the drive pawl; and masking means providing a predetermined point at which the drive pawl engages the second ratchet teeth during a time when the drive pawl is in working relation to the second ratchet teeth.

The present invention relates to a timing mechanism and, more particularly, to a timing mechanism having a means to provide short pawl strokes during non switching time periods.

Timing mechanisms have been used in the appliance industry for many years to control the sequential operation of an appliance such as a washer, dryer, dishwasher and of recent years, microwave ovens. Of recent years, the programs required in such applications have become sufficiently complicated that providing for sufficient space on the cams for the programs has become increasingly difficult. The present timing mechanism helps to overcome the problem by providing for shorter effective strokes of the drive pawl during non switching time periods.

FEATURES OR OBJECTS OF THE INVENTION

It is, therefore a feature of the present invention to provide a timing mechanism having a means to provide shorter effective strokes of a drive pawl during non switching time periods. Another feature of the invention is to provide a timing mechanism wherein such means is simple and easy to produce. Another feature of the invention is to provide such a timing mechanism which utilizes two cooperating sets of ratchet teeth of different major diameters. Still another feature of the invention is to provide such a timing mechanism wherein a single drive pawl having a fixed stroke selectively engages the two sets of ratchet teeth. Another feature of the invention is to provide a masking means to provide a predetermined point at which the drive pawl engages one of the sets of teeth when such set is in working relation to the drive pawl. These and other features of the invention will become apparent from the following description taken in conjunction with the accompanying drawings.

DESCRIPTION OF THE DRAWINGS

FIGS. 3A–6A are sections taken along the lines 3A–6A of FIGS. 3–6, respectively.

DETAILED DESCRIPTION OF THE DRAWINGS

Figure 1:
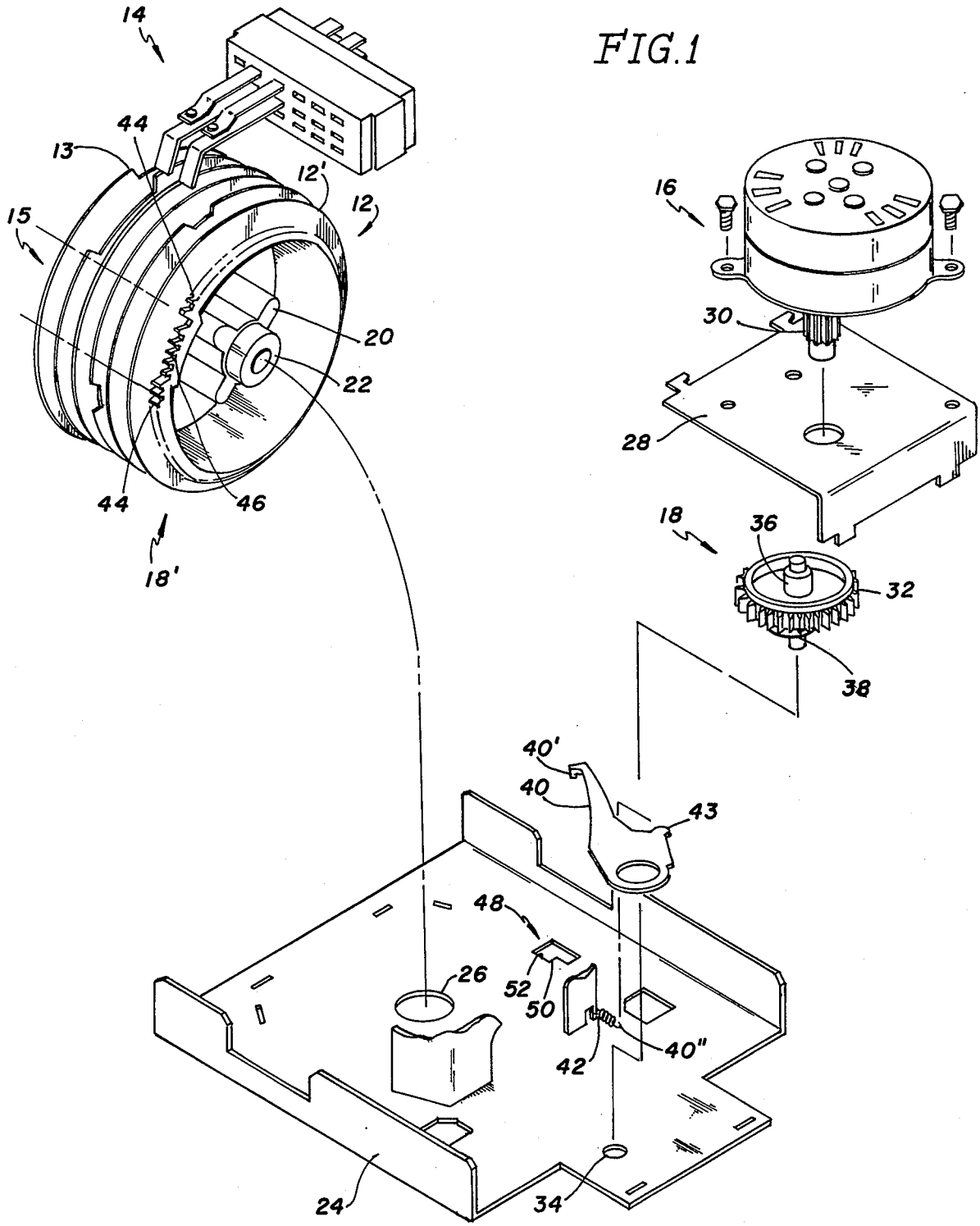
FIG. 1 is an exploded view of a timing mechanism employing the features of the invention.

Referring now to FIG. 1, there is shown a timing mechanism 10 which, in general, includes a cam means 12 which upon rotation selectively opens and closes electrical switch means 14 that engages the cam means, and a motor drive means 16 which applies power driven rotation to the cam means 12 through drive means 18. Cam means 12 includes a plurality of cams 12' having coded indicia 13 thereon and that are integrally formed on a hub portion 20 and a shaft 22, shaft 22 being rotatably journalled in base plate 24 through aperture 26. Motor drive means 16 is carried on a plate 28 which is secured to base plate 24. Motor drive means 16 may be of any suitable type known in the industry such as a synchronous motor.

Drive means 18 includes a motor output pinion 30 which extends through plate 28 and engages a drive gear 32, the drive gear 32 having a major axis defined by hub and shaft 36 which is rotatably journalled in base plate 24 through aperture 34. Gear 32 also includes an eccentric 38 which is slightly off center of the major axis. A drive pawl 40 of a fixed stroke is carried by eccentric 38 to be rotated in accordance with the movement of the eccentric. The portion of the drive means 18 described thus far, as well as the other elements of the timing mechanism previously described are well known in the art and form no part of the present invention.

Figure 2:
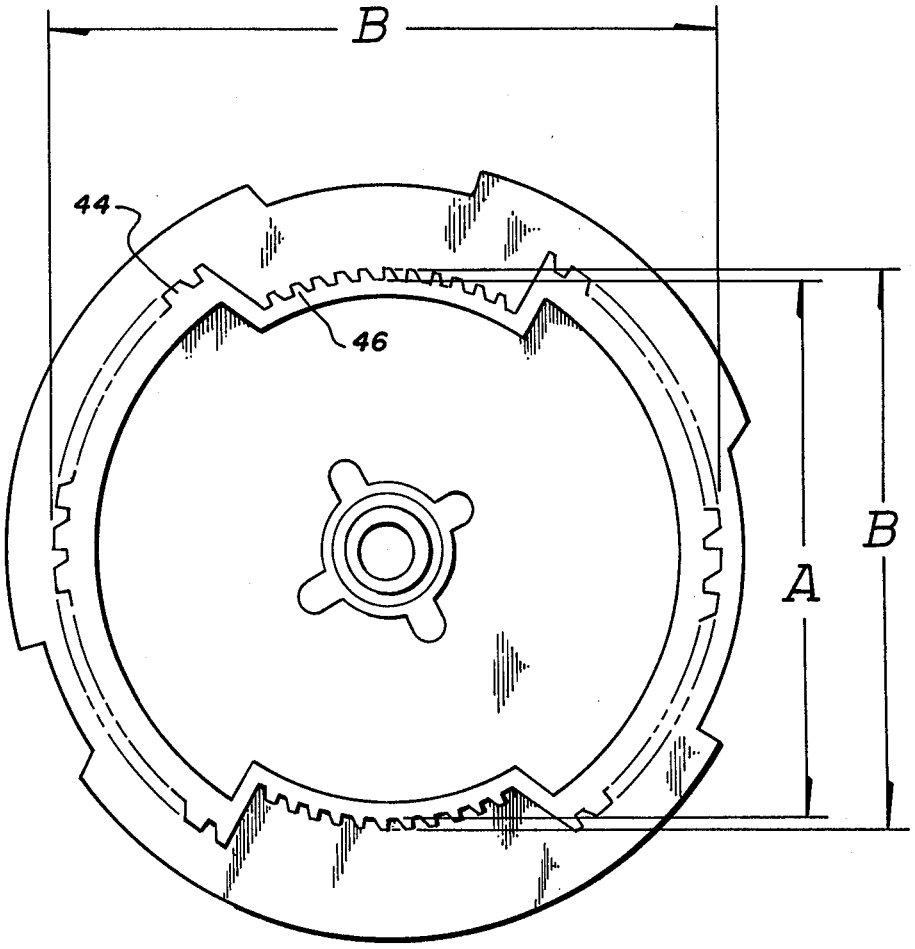
FIG. 2 is a view of a typical ratchet illustrating major and minor diameters.

The present invention is concerned with the drive portion 18' of drive means 18 which provides a means to shorten the effective stroke of drive pawl 40 during the period of time when switch means 14 are in a non operating mode even though electric power has been applied to the device. Drive means 18' includes first ratchet teeth 44 which are integral with cam means 12 and second ratchet teeth 46 which are also integral with cam means 12. Each of the ratchet teeth has a major and minor diameter. For the purposes of the present invention, the meaning of the terms major and minor diameters are illustrated in FIG. 2. Referring to FIG. 2, a major diameter B is the distance to the outermost point of the teeth while a minor diameter A is a distance to the base of the teeth. Ratchet teeth 46 has a major diameter B which is less than the major diameter of ratchet teeth 44.

Returning to FIG. 1, and as will be hereinafter explained, drive pawl 40 selectiely engages either of ratchet teeth 44 and ratchet teeth 46 during predetermined periods of time. A stop pawl (not shown for simplicity) engages ratchet teeth 44 to prevent backlash of cam means 12 during its intermittent rotation in a manner well known in the art Pawl 40 is spring biased through coil spring 40'' to insure engagement of the pawl with ratchet teeth 44. The spring is held by tang 42 and shoulder 43 of pawl 40.

The number of teeth of ratchet teeth 46 corresponds to the amount of non switching time desired. For example, each tooth could be driven once every hour. The location of the teeth and cam means 12 with respect to a zero start time as to the number of non switching hours desired can then be manually set by manually rotating an extension of shaft 22 (not shown) through a clutch in a manner well known in the art.

According to a feature of the invention, there is provided a masking means 48 that provides a predetermined point at which drive pawl 40 engages teeth 46 when the drive pawl is in working relation to the teeth.

Masking means 48 includes a shelf 50 that is formed from base plate 24 in aperture 52 of the base plate. As will be apparent, the shelf prevents pawl 40 from engaging teeth 46 until the pawl is driven over the shelf. Pawl 40 includes an extension 40' at its distal end for engagement of the pawl with shelf 50.

With the present arrangement, shorter effective pawl strokes are provided during non switching time periods. More specifically, in the usual pawl drive type timer, with a pawl stroke of x degrees, the minimum tooth spacing is slightly more than $\frac{1}{2}$x degrees in order to prevent pickup of 2 teeth. With the use of masking means 48 in combination with ratchet teeth of different major diameters, the effective stroke of the pawl is reduced by Y degrees (the size of masking means 48) on ratchet teeth 46. This permits the tooth spacing of ratchet teeth 46 to be reduced to $\frac{1}{2}$ (x−Y).

Figure 3A:
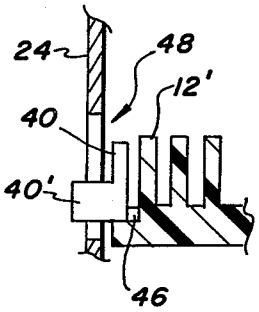
Figure 3:
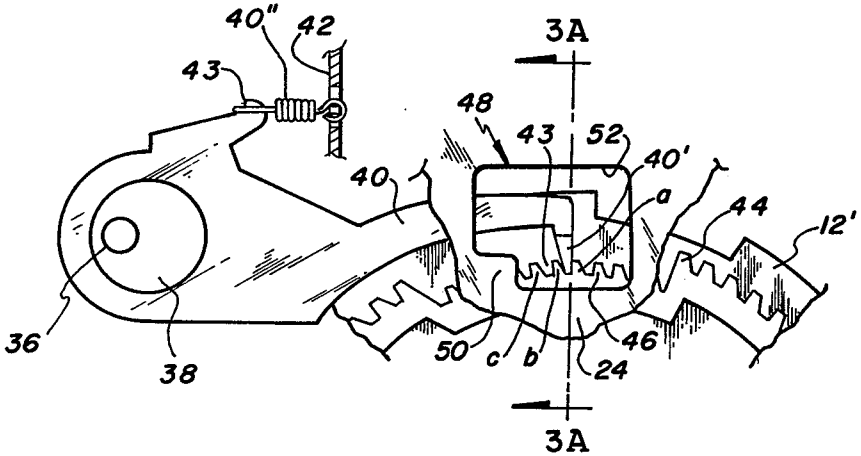
FIGS. 3–6 are similar views illustrating four modes of operation of the drive means of the present invention.
Figure 4A:
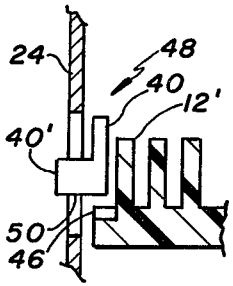
Figure 5A:
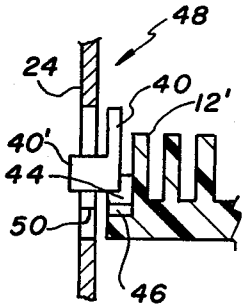
Figure 4:
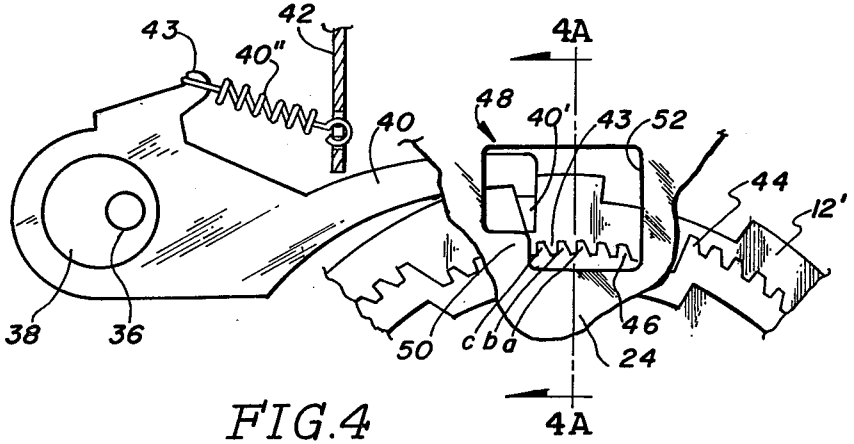
Figure 5:
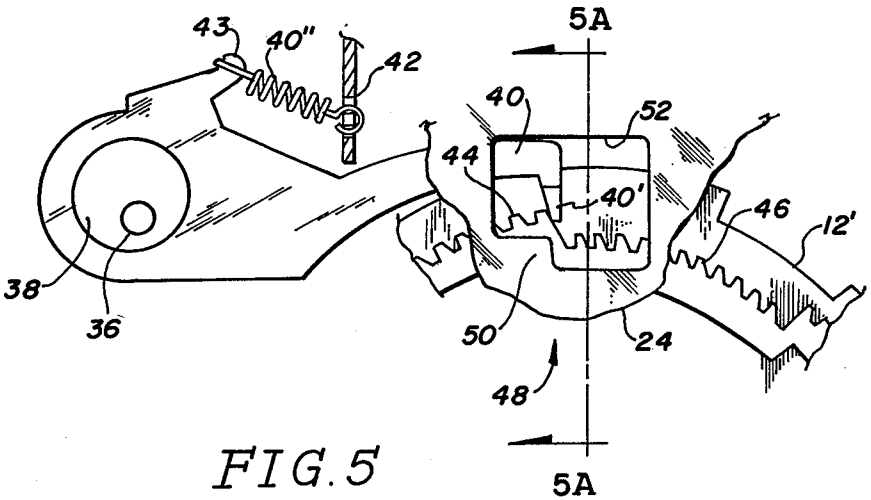
Figure 6A:
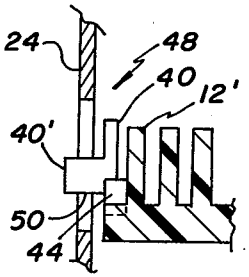
Figure 6:
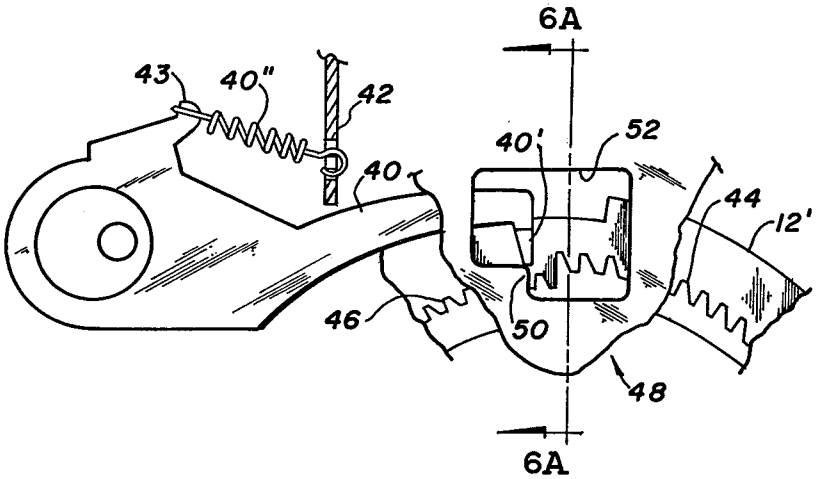

The operation of drive means 18' can now be described with reference to FIGS. 3–6A. Drive pawl 40 is being driven by eccentric 38 which is rotating in a clockwise direction. In FIGS. 3 and 3A, drive pawl 40 is engaging teeth 46. Cam means 12 will advance one step in accordance with an advance of the teeth. However, it should be understood that during this time, cam means 12 will not be in a position to activate any of the switches of electrical switch means 14. More specifically, and as previously noted, the number of teeth in ratchet teeth 46 corresponds to non-switching time periods. Therefore, a portion 15 (FIG. 1) of the perimeter of cam means 12 that is in line with and approximately equal to the arc length of ratchet teeth 46 will be free of coded indicia 13 which control functions of the appliance so that corresponding switches of switch means 14 cannot be activated. As shown in FIGS. 3 and 3A, pawl 40 is fully extended to move tooth 'a' to the position shown. When pawl 40 is retracted it will move into and out of the valley 43 adjacent tooth 'b' and, as shown in FIGS. 4 and 4A, come to rest on shelf 50 to thus prevent the pawl from engaging tooth 'c'. Thus for the fixed stroke of the pawl, the pawl is not permitted to skip a tooth (tooth 'b') and move more than one tooth at a time. When pawl 40 is extended on the next stroke it will engage tooth 'b' and drive it to the position of 'a' shown in FIGS. 3 and 3A. This sequence is continued until drive pawl 40, as shown in FIGS. 5 and 5A, reaches teeth 44 to begin engagement with them to advance cam means 12 in accordance with the spacing of teeth 44 to operate switch means 14. Pawl 40 drives teeth 44 until, as shown in FIGS. 6 and 6A, on a retracting stroke it reaches shelf 50, to position the pawl for the start of another cycle.

What is claimed is:

1. In a timing mechanism wherein a camstack is intermittently rotated and wherein electrical switches are opened and closed in accordance with coded indicia of said camstack, an intermittent drive means intermittently moving said camstack comprising:

(a) motor drive means, (b) a drive pawl of a fixed stroke coupled to said motor drive means, (c) rotatable ratchet means coupled to said camstack including first ratchet teeth of a first major diameter, and second ratchet teeth of a second lesser major diameter than said first ratchet teeth in axial alignment with said first ratchet teeth, said first and second ratchet teeth arranged with respect to each other to be separately selectively in working relation to said drive pawl, and (d) masking means preventing said drive pawl from engaging selected ones of said second ratchet teeth during a time when said drive pawl is in working relation to said second ratchet teeth.

2. In a timing mechanism wherein said masking means includes an aperture in a place of a housing and a shelf provided in said aperture and selectively engaged by said drive pawl.

* * * * *